US006179584B1

(12) United States Patent
Howitz et al.

(10) Patent No.: US 6,179,584 B1
(45) Date of Patent: Jan. 30, 2001

(54) MICROEJECTOR PUMP

(75) Inventors: Steffen Howitz, Dresden; Thomas Wegener, Neuruppin; Mario Burger, Pirna; Thomas Gehring, Ebersbach, all of (DE)

(73) Assignee: Gesim Gesellschaft fur Silizium-Mikrosysteme mbH, Rosendorf (DE)

( * ) Notice: Under 35 U.S.C. 154(b), the term of this patent shall be extended for 0 days.

(21) Appl. No.: 09/330,121

(22) Filed: Jun. 10, 1999

Related U.S. Application Data

(63) Continuation of application No. PCT/DE97/02874, filed on Dec. 11, 1997.

(30) Foreign Application Priority Data

Dec. 11, 1996 (DE) ..... 196 51 568

(51) Int. Cl.[7] ..... F04B 17/00
(52) U.S. Cl. ..... 417/413; 417/322; 604/68
(58) Field of Search ..... 417/413, 322, 417/413 A, 413.2, 413.1, 413.3, 207, 482; 250/289; 310/328; 604/68; 435/6, 286.5; 204/453

(56) References Cited

U.S. PATENT DOCUMENTS

| | | | | |
|---|---|---|---|---|
| 4,152,098 | * | 5/1979 | Moody et al. | 417/413 |
| 5,094,594 | | 3/1992 | Brennan . | |
| 5,171,132 | * | 12/1992 | Miyazaki et al. | 417/413 |
| 5,259,737 | * | 11/1993 | Kamisuki et al. | 417/322 |
| 5,277,556 | * | 1/1994 | Van Lintel | 417/413 A |
| 5,659,171 | * | 8/1997 | Young et al. | 250/289 |
| 5,681,152 | * | 10/1997 | Ahs | 417/413.2 |
| 5,691,593 | * | 11/1997 | Takeuchi et al. | 310/328 |
| 5,725,363 | * | 3/1998 | Bustgens et al. | 417/413.1 |
| 5,759,014 | * | 6/1998 | Van Lintel | 417/413.3 |
| 5,840,062 | * | 11/1998 | Gumaste et al. | 604/68 |
| 5,856,174 | * | 1/1999 | Lipshutz et al. | 435/286.5 |
| 5,871,336 | * | 2/1999 | Young | 417/207 |
| 5,880,071 | * | 5/1979 | Parce et al. | 204/453 |
| 5,899,675 | * | 5/1999 | Van Heuman et al. | 417/482 |
| 6,033,191 | * | 3/2000 | Kamper et al. | 417/322 |
| 6,054,277 | * | 4/2000 | Furcht et al. | 435/6 |

FOREIGN PATENT DOCUMENTS

| | | |
|---|---|---|
| 4422743 | 1/1996 | (DE) . |
| WO9419609 | 9/1994 | (WO) . |

OTHER PUBLICATIONS

Jeang et al. "Experiments and Analysis for Micro–Nozzle/Diffuser Flow and Micro Valveless Pumps," pp. 369–372 Transducers 1997 (Jun. 19, 1997).

* cited by examiner

*Primary Examiner*—Teresa Walberg
*Assistant Examiner*—Leonid Fastovsky
(74) *Attorney, Agent, or Firm*—Baker Botts L.L.P.

(57) ABSTRACT

A microejector pump for generating microdrops includes at least one pump chamber configured in a silicon chip and a piezoelectrically actuable silicon membrane arranged over the pump chamber. The pump chamber is connected to at least one supply line as well as a discharge line provided with an ejection orifice. A glass chip closes off at least the pump chamber from the silicon membrane. The microejector pump can also include an integral heater and controller.

17 Claims, 4 Drawing Sheets

MICROEJECTOR PUMP

REFERENCE TO RELATED APPLICATION

This is a continuation of copending International application No. PCT/DE97/02874 filed Dec. 11. 1997.

FIELD OF THE INVENTION

The invention relates to a microejector pump for generating microdrops, consisting of at least one pump chamber configured in a silicon chip, (and) a silicon membrane arranged over the pump chamber and piezoelectrically actuable, the pump chamber being connected to at least one supply line and a discharge line provided with an ejection orifice, in which a glass chip closes off at least the pump chamber from the silicon membrane.

By means of such microejector pumps, the handling of extremely small quantities of fluid is made possible, which may be either pure substances or mixtures of substances, or alternatively contain microparticles suspended in liquids, to be subjected to controlled further processing in chemical analysis, medical technology, biotechnology, etc.

These microejector pumps, in combination with a suitable handling device, for example manipulators, permit the controlled release of these substances at the point of further sample processing or of sample disposal, as the case may be. Using a suitable positioning technique, the points of sampling and sample deposition may be different. The point of sample deposition may be a liquid surface, a solid surface, or else a gas-filled reaction chamber.

A micropump intended for the above purposes is disclosed in U.S. Pat. No. 5,094,594. This patent discloses a micropump which consists of a pump unit having an associated pump chamber and a deformable chamber sector on which an electrically triggerable piezoelement is arranged. The liquid to be delivered is supplied to the pump chamber by way of an inlet capillary (supply line). The force alternately exerted on the deformable chamber sector by the actuation of the piezoelement effects a continuous pressure variation in the pump chamber, so that alternately a loading thereof by way of the inlet capillary and an expulsion of the liquid by way of an outlet capillary in communication with the pump chamber takes place. To achieve an adequate pump action, piezoelectrically actuable valves are provided in each of the inlet and outlet capillaries.

The production of such a micropump in a silicon substrate may be accomplished by the known process of photolithography and anisotropic textural etching. On the silicon substrate so textured, a glass plate is then applied by anodic bonding, thus creating a firm glass-silicon bond.

With such a micropump, it is possible to apply small quantities of fluid, although only a comparatively limited frequency range and hence only a limited delivery rate are available. For example, with the micropump just described, for example a delivery of only about 500 picoliters is attainable. To ensure the requisite functional dependability of this micropump, it is necessary that the liquids or suspensions exhibit as low a viscosity as possible.

In addition, WO A 9419609 shows a micropump containing a pump chamber with variable chamber volume and a liquid inlet as well as a liquid outlet. In order to obtain liquid transport through the pump chamber towards the liquid outlet and at the same time to dispense with the wear-prone valves otherwise required, here a combination of a diffuser with a nozzle is provided. This diffuser is associated with the liquid inlet and the nozzle with the liquid outlet.

SUMMARY OF THE INVENTION

An object of the invention is to create a microejector pump suitable for handling of liquids, suspensions, or liquefiable substances, in the volume range from a few picoliters up to hundreds of microliters, while exhibiting high frequency stability.

According to the invention, the object is accomplished with a microejector pump wherein the supply line is configured at least partially as a diffuser element in the direction of the pump chamber and in that the exit channel opens in an exit plane.

By the interposition of the diffuser element ahead of the pump chamber according to the invention, the frequency stability of the microejector pump is considerably improved. The anisotropy of the diffuser flow resistance supports droplet formation in pump mode, that is, a nozzle effect is produced along the positive pressure gradient, and in loading mode, the liquid backflow into the pump chamber is supported. That is, a diffuser effect is produced along the positive pressure gradient. Furthermore, the diffuser effect in loading mode effectively suppresses the generation of air bubbles in the pump chamber at high frequencies. In this way, extremely high delivery rates up to about 750 mcl/minute can be achieved, at an excitation frequency up to about 6500 Hz. In the use of the microejector pump according to the invention for printing, a higher pressure velocity can be attained by the diffuser.

The outlet passage is further configured as a microcapillary, so that the sample release takes place in the form of individually countable, directed, pulse-accelerated microdroplets of defined drop volume, reproducibly. The volume of the drops and the delivery rate are adjustable through the electrical parameters (frequency, amplitude, pulse shape) of the pump control.

Preferably, the diffuser element is placed immediately ahead of the pump chamber, or extends directly to the pump chamber. In a first variant of the invention, the diffuser element, has a constant aperture angle. The aperture angle of the diffuser element should be at most 10 degrees, with an aperture angle of about 3 to 5 degrees being preferred.

In a second embodiment of the invention, the diffuser element exhibits a continuously varying aperture angle. The aperture angle can for example, increase continuously.

In another embodiment of the invention, the pump chamber has a base outline of straight or curved boundary lines, while the diffuser element opens in an entrance zone of the pump chamber. The outlet is arranged in opposition to the entrance zone.

The outlet passage is further configured as a microcapillary, so that the sample release takes place in a reproducable form of individually countable, directed, pulse-accelerated microdrops of defined drop volume. The volume of the drops and the delivery rate are adjustable by means of the electrical parameters (frequency, amplitude, pulse shape) of the pump control.

In addition, the microcapillary is connectable to other supply passages between the pump chamber and the ejection orifice. Thus it is possible to mix other substances in a controlled manner with the liquid delivered through the pump chamber.

Preferably, the microejector pump consists of a composite of a micromechanically textured silicon chip and a glass chip.

To avoid contamination, the microejector pump, i.e., the composite of silicon chip and glass chip, is diminished in an x- and/or y-direction towards the ejection orifice of the outlet passage. This ensures that upon superficial immersion of the microejector pump in a liquid, only an extremely slight surface contamination will occur, which is easily removable in a following purification step. Thus, contamination can be prevented. The micro-ejector pump according to the invention is therefore especially suitable for manipulation of extremely small quantities of fluid.

The diminution in an x-direction may advantageously be configured during the sawing of the silicon chip, whereas the diminution in y-direction may be configured during the anisotropic textural etching. It is possible also to form the diminutions subsequently by a final grinding operation.

In another embodiment of the invention, the silicon chip is directly heatable under temperature control, i.e. the ohmic resistance of free silicon is utilized, the heating effect being produced due to Joulean heat in the silicon material.

The heating is preferably integrated into the silicon membrane, or acts directly thereupon, the electrical contacts being arranged laterally opposed to the silicon chip.

By the refinement of the invention with heat acting at least on the pump chamber, various possible arrangements of the diffuser element according to the invention are very considerably enlarged, without requiring additional design changes in the microejector pump itself, e.g., as to dimensioning. Furthermore, the heating makes it possible to perform an external drying of the microejector pump in a rapid and simple manner.

Besides, it is now possible to handle even highly viscous liquids that become low-viscosity liquids, under the influence of heat. Such liquids may for example be oily substances or substances containing glucose, which may then be handled utilizing the advantages of the diffuser element.

With suitable design of the heating system, even molten metal, for example tin or tin-lead alloys, or other substances otherwise not deliverable by prior microejector pumps because of their viscosity, can be handled without problems.

In a further refinement of the invention, a temperature sensor with associated control circuits is arranged on the silicon chip. Thus, it is possible, in combination with a suitable throughflow meter, to regulate all parameters of the microejector pump electrically, so that accurately defined quantities of liquid are delivered with no losses.

The electrical contacts and the temperature sensor should consist of a chemically neutral material, photolithographically textured platinum or tantalum coatings being especially suitable for this purpose.

An especially advantageous refinement of the invention is a parallel arrangement of several pump chambers, each with an associated inlet diffuser and outlet passages.

Thus, an extremely functional microejector pump is created, with which a highly parallel operation is possible. Alternatively, the pump chambers can be controlled separately. In the latter variant, operation of various pump chambers can take place simultaneosly or staggered in time, to permit handling of diverse materials or liquids.

In the parallel arrangement, it is expedient, to provide an aspiration passage between the several outlet passages in each instance, likewise opening in the exit plane. This prevents the liquid emerging from one exit orifice from spreading out over neighboring exit orifices.

BRIEF DESCRIPTION OF THE DRAWING

The invention will be illustrated below in more detail in terms of an embodiment by way of example. Of the several figures in the drawing.

Figure 3:
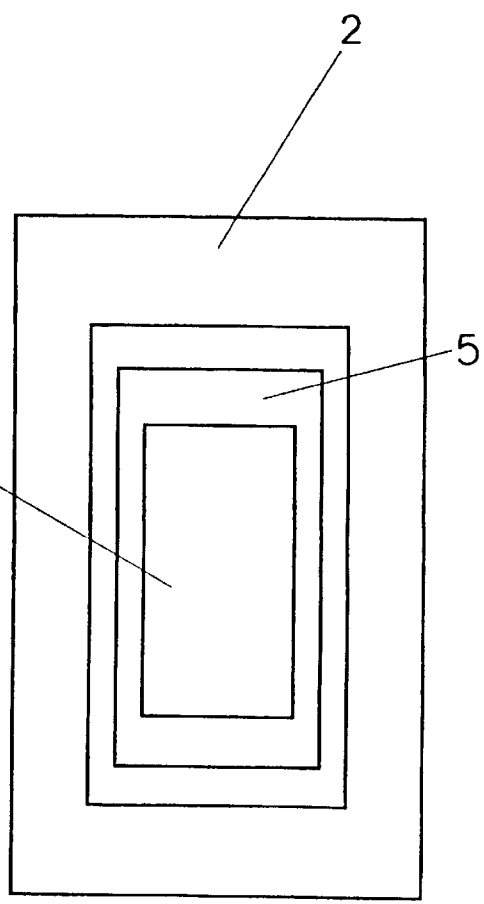
FIG. 3 shows the top view of the microejector pump of FIGS. 1 and 2.

Throughout the figures, the same reference numerals and characters, unless otherwise stated, are used to denote like features, elements, components or portions of the illustrated embodiments. Moreover, while the subject invention will now be described in detail with reference to the figures, it is done so in connection with the illustrative embodiments. It is intended that changes and modifications can be made to the described embodiments without departing from the true scope and spirit of the subject invention as defined by the appended claims.

DETAILED DESCRIPTION OF PREFERRED EMBODIMENT

Figure 2:
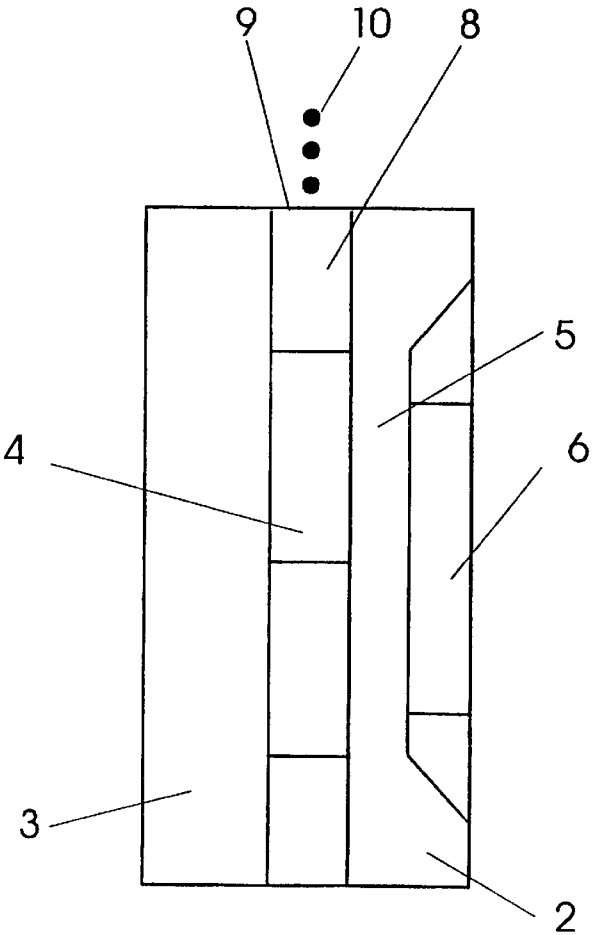
FIG. 2 shows a side view, represented in cross-section, of the microejector pump of FIG. 1.
Figure 1:
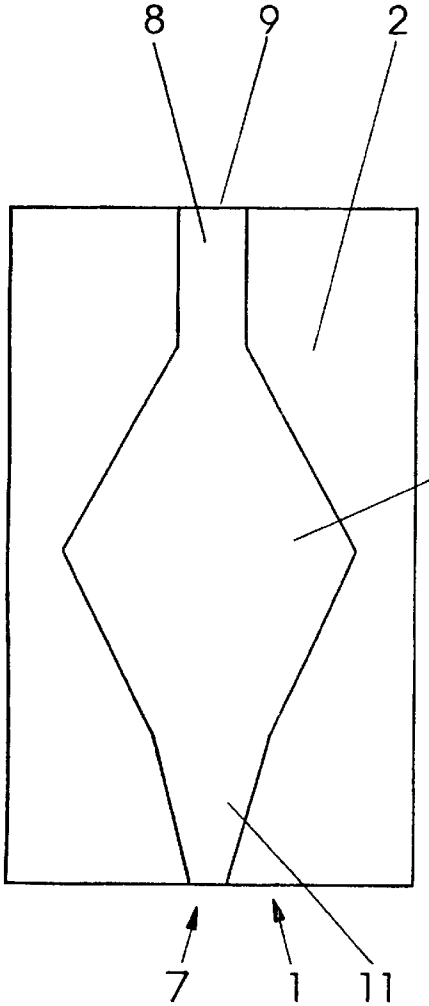
FIG. 1 shows a top view, schematically represented in cross-section, of the microejector pump.

The microejector pump 1 represented in FIGS. 1 to 3 consists of a composite of a silicon chip 2 and a glass chip 3 connected to each other by anodic bonding. The silicon chip 2 is bilaterally textured, a flat pump chamber 4 closed off from the outside by a silicon membrane 5 (FIG. 2) being configured on the side opposed to the glass chip 3. On this silicon membrane 5, a piezoelectric plate actuator 6 is affixed, for example by means of the known chip bonding techniques. With the aid of this plate actuator, a deflection of the silicon membrane 5 is effected, so that the volume of the pump chamber 4 is alternately enlarged and reduced, thus achieving the pump action.

The triggering of the piezoelectric plate actuator 6 may be effected by an electronic control signal, not shown, at a preassigned frequency and amplitude. Here it has proved expedient to provide a fast rising edge in the control signal, i.e., an abrupt switch-on pulse. The following switch-off pulse may exhibit an attenuated flat curve, e.g. according to an exponential function. This further improves the performance of the microejector pump according to the invention.

It is also expedient to impress a bias voltage on the piezoelectric plate actuator 6 during a loading mode, i.e., prior to the switch-on pulse. This bias voltage should be directed contrary to the polarity of the switch-on pulse to increase the volume of the pump chamber 4. The greater volume of the pump chamber 4 in loading mode serves to improve the output of the microejector pump 1.

Figure 4:
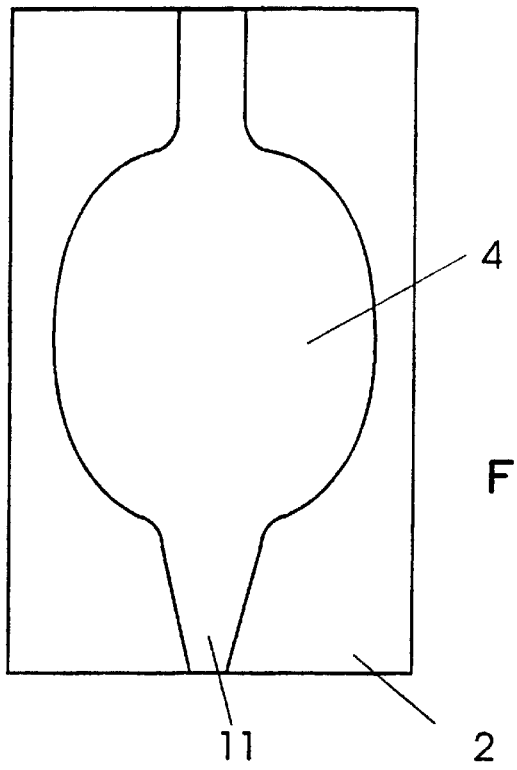
FIG. 4 shows a schematic representation of a variant of the microejector pump, with a round pump chamber.
Figure 6:
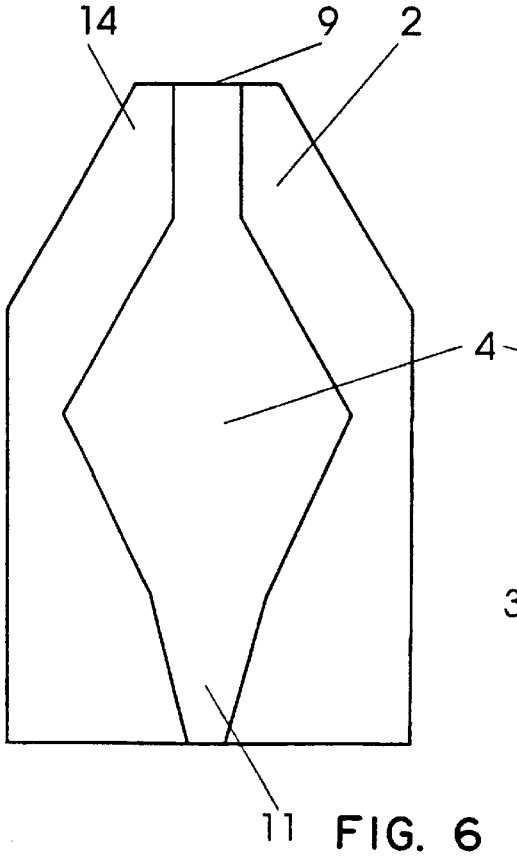
FIG. 6 shows a microejector pump having diminutions in x-direction.
Figure 7:
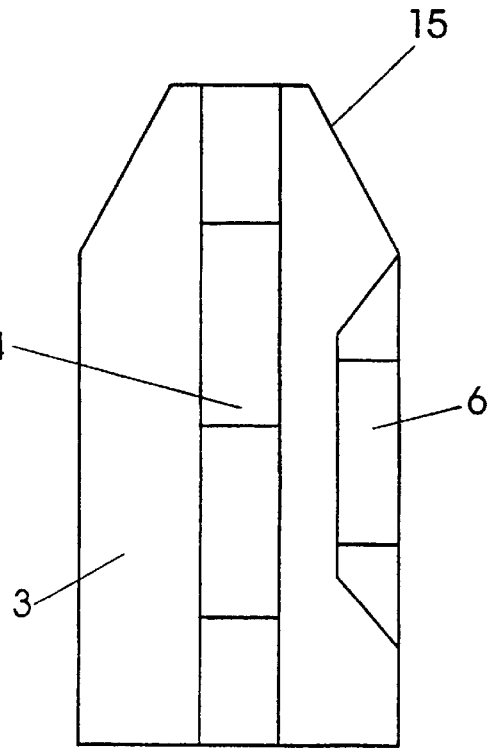
FIG. 7 shows a microejector pump having diminutions in y-direction.

Further, the pump chamber 4 is provided with a supply passage 7 and an outlet passage 8, the outlet passage 8 being provided with an ejection orifice 9 for ejection of individual microdrops 10. The pump chamber 4 comprises a substantially square or rectangular base outline, the supply passage 7 connected to a fluid inlet 16 (FIGS. 8, 9) opening into an entrance zone of the pump chamber 4. The outlet passage 8 is arranged on the opposed side of the pump chamber from the supply passage 7. In principle, the pump chamber 4 may alternatively comprise a base outline with curved boundary lines, being for example round (FIG. 4) or oval shaped (FIG. 9).

The supply passage 7 is configured as a diffuser element 11, i.e., the supply passage 7 or at least a portion thereof enlarges towards the pump chamber 4. This diffuser element 11 may be of such arrangement that the aperture angle is constant over the entire length of the diffuser element 11. Alternatively, it is possible to form the diffuser element 11 in such manner that the aperture angle varies continuously. Thus, the aperture angle may increase continuously within preassigned limits as illustrated in FIG. 9.

In principle, it is possible to connect the outlet passage 8, in microcapillary configuration, with additional supply passages between the pump chamber 4 and the ejection orifice 9. In this way, other substances may be mixed with the liquids delivered from the pump chamber 4, substantially broadening the possible applications of the microejector pump.

The equipment of the microejector pump 1 with a diffuser element 11 according to the invention provides for stable operation over a wide frequency range. The delivery rate of the microejector pump 1 may be controlled by way of the excitation frequency for the plate actuator 6. An especially steep switch-on pulse and a flat switch-off pulse preferable, since it prevents the generation of gas bubbles in the pump chamber 4 as well.

The possible applications for the microejector pump are expanded by the integration of a heating system, at least into the silicon membrane 5 of the silicon chip 2.

Thus, the microejector pump 1 may be employed not only for handling liquids or suspensions of low viscosity but also for such materials as become of low or lower viscosity upon elevation of temperature. Another aspect of the integrated heating is that it provides for drying of the wetted areas of the microejector pump 1. For example, external wetted areas of the microejector pump 1 can be dried rapidly, thereby, preventing any entrainment of fluids.

Figure 8:
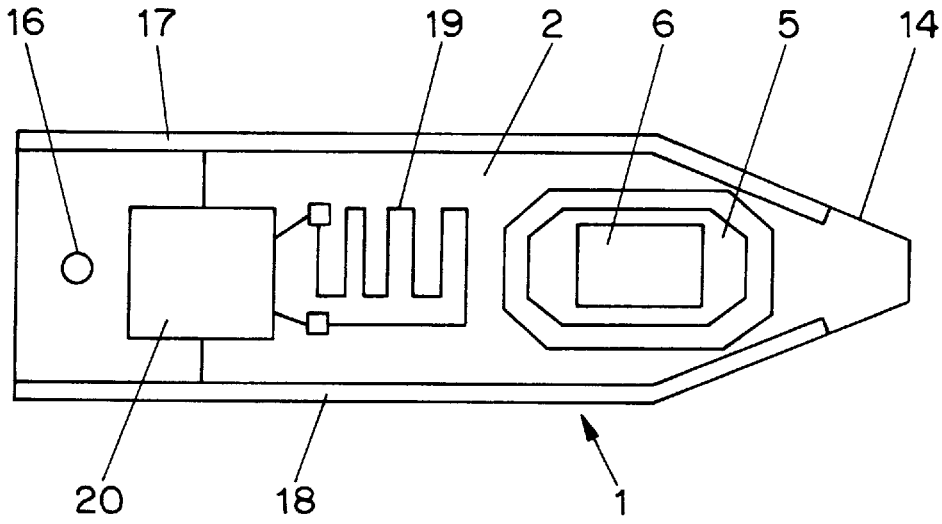
FIG. 8 shows the rear view of the silicon chip for a microejector pump with temperature sensor and control circuit.
Figure 9:
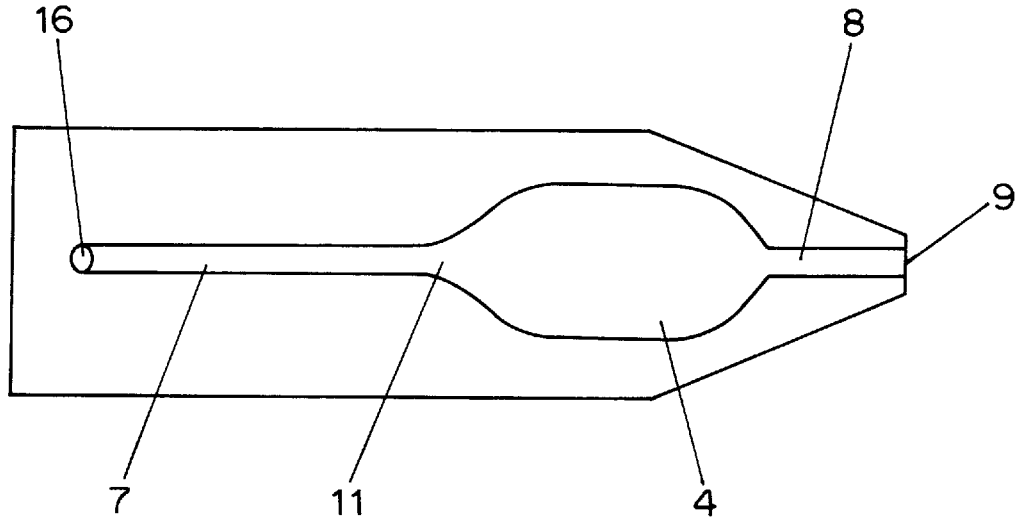
FIG. 9 shows the front view of the silicon chip of FIG. 8, with an ovular pump chamber.

Referring to FIG. 8, the heating system may be integrated in simple manner by using the electrical resistance of the silicon chip 2 directly for heating. For electrical contacting to achieve this end, electrical contacts 17, 18 are provided, extending in lengthwise direction laterally facing the silicon chip 2. A temperature sensor 19 is arranged on the silicon chip 2 which provides a signal to a control circuit 20. The control circuit 20 provides a signal to contacts 17, 18 in response to the signal from sensor 19 in order to control the heating operation. Thus, a controlled heating of the microejector pump 1 is achieved and even intrinsically highly viscous liquids or suspensions can be delivered, such as oils, greases or liquids containing glucose, by the microejector pump 1. With suitable design of the heating system, even fusible metals may be handled in this way, so that the microejector pump 1 is suitable also for printing of metals such as tin or lead-tin alloys or other substances.

Since the types of fluids which may be transported by the microejector pump 1 is not in principle limited, all parts that may come into contact with fluids must be chemically neutral. For this reason, it is expedient to make the electrical contacts 17, 18 and the temperature sensor 19 of a photolithographically textured platinum or tantalum coating.

In order to keep the wetted or contaminated surface of the microejector pump 1 as small as possible upon deposition of fluids on or in liquid surfaces, it is advantageous if the composite of the silicon chip 2 and the glass chip 3 is tapered in an x- and/or y-direction towards the ejection orifice 9 of the outlet passage 8, as represented in principle in FIGS. 6 to 9. This can be done by configuring the tapering 14 in an x-direction during sawing of the silicon chip 2. The tapering 13 in a y-direction may be formed in a simple manner during the anisotropic textural etching of the semiconductor chip 2.

Of course, the tapering 14, 15 may alternatively be fashioned by a final grinding operation, in which case a diminution of the glass chip 3 in the y-direction may be produced as well.

Another possibility for keeping such contamination to a minimum consists of providing the immersion region of the microejector pump 1 with a hydrophobic surface treatment. This may be accomplished by silanizing or by coating, for example with a layer similar to a Teflon coating. This layer of carbon and fluorine may be produced by plasma polymerization. In general, however, care must be taken here that the interior of the passage and chamber region of the microejector pump 1 carrying fluid will not be coated as well.

Among the advantages of the invention are in that the diffuser element 11 achieves a substantial improvement of the frequency stability of the microejector pump 1. The anisotropy of the flow resistance of the diffuser element 11 in pump mode supports the formation of the microdrops 10, i.e., a nozzle effect is generated along the positive pressure gradient. In the loading mode of the pump chamber 4, the liquid backflow is supported, i.e., a diffuser effect is generated along the positive pressure gradient. Furthermore, the diffuser effect in loading mode suppresses the generation of air bubbles in the pump chamber 4, especially at high excitation frequencies of the plate actuator 6. Thus, the microejector pump 1 is serviceable over a broad frequency range, and even extremely high delivery rates up to about 750 mcl/minute, at an excitation frequency of about 6500 Hz, can be reached.

With the aid of the heating integrated into the silicon chip 2 and the temperature sensor 19 with associated control circuit 20, the microejector pump 1 may be employed for any liquids, suspensions of relatively high viscosity, as well as fusible metals and the like, if these materials can be rendered of sufficiently low viscosity in an acceptable temperature range. Also, as already explained, a rapid drying of wetted areas of the microejector pump 1 can be brought about.

The supply of the materials to be handled from a storage vessel to the pump chamber 4 can be accomplished by way of ordinary hoses and couplings.

Figure 5:
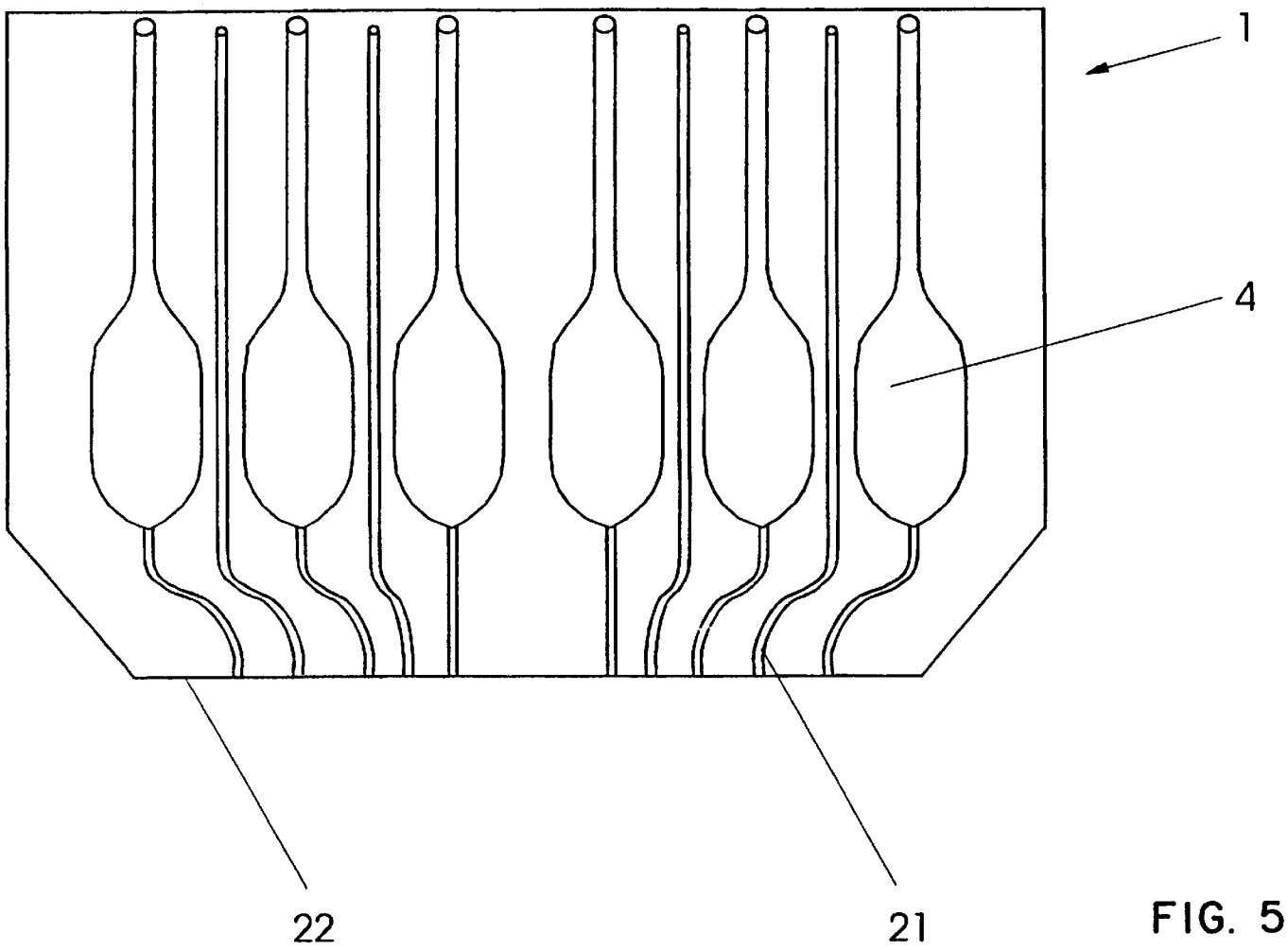
FIG. 5 shows a microejector pump having a multipassage system.

The application of the conformation of the microejector pump 1 with diffuser element 11 according to the invention is not limited to the presence of only one pump chamber 4. It is also possible to build microejector pumps having a parallel arrangement of pump chambers 4 in communication with the diffuser elements 11, according to the invention as illustrated in FIG. 5. If this arrangement is connected in parallel, an extremely high-performance microejector pump results. Also, highly effective parallel operation is possible by suitably triggering the individual pump chambers 4 separately. In the latter case, however, it is expedient, between the single outlet passages 9, to provide an additional aspiration passage 21 along with an opening in the exit plane 22 in each instance. Thus, the propagation of liquid in the exit plane 22, and hence a contamination of neighboring exit orifices 9, can be prevented.

The technological embodiments of the microejector pump 1 according to the invention can be accomplished by the use of known microtechnical microconformation methods, and the conformation of the silicon chip 2 with the glass chip 3 by means of anodic bonding.

In a first process of separation, consisting of the steps of thermal oxidation, photolithography and anisotropic textural etching, the bilaterally textured silicon chip 2 is first produced. This silicon chip 2 thus acquires the structure of a microejector pump 1 with outlet passage 8, pump chamber 4 with associated silicon membrane 5, and supply passage 7 with diffuser element 11. The silicon chip 2 so structured, after a multistage cleaning operation, is assembled with a glass chip 3, consisting of a Pyrex 7740 glass plate, by anodic bonding, forming a fixed silicon-glass composite. The production of the parallel arrangement may be accomplished in the same fashion as hereinbefore described.

The thickness of the glass plate is, for example, 1 mm and that of the silicon membrane between 50 and 190 microns. The thickness of the piezoelectric plate actuators 6 should lie in the range from 100 to 260 microns.

Although the present invention has been described in connection with specific exemplary embodiments, it should be understood that various changes, substitutions and alterations can be made to the disclosed embodiments without departing from the spirit and scope of the invention as set forth in the appended claims.

What is claimed is:

1. A microejector pump for generating microdroplets, comprising:

a silicon chip having at least one pump chamber;

a piezoelectrically actuable silicon membrane arranged over the pump chamber, the pump chamber being connected to at least one supply passage and one outlet passage provided with an ejection orifice; and a glass chip closing off the pump chamber opposite the silicon membrane, wherein the supply passage located in the silicon chip is configured at least in part as a diffuser element in the direction of the pump chamber and the outlet passage opens in an exit plane.

2. The microejector pump according to claim 1, wherein the diffuser element is arranged immediately ahead of the pump chamber.

3. The microejector pump according to claim 1, wherein the diffuser element exhibits a constant aperture angle.

4. The microejector pump according to claim 3, wherein the aperture angle of the diffuser element is at most 10 degrees.

5. The microejector pump according to claim 3, wherein the aperture angle is preferably 3 to 5 degrees.

6. The microejector pump according to claim 1, wherein the diffuser element exhibits a continuously varying aperture angle.

7. The microejector pump according to claim 1, wherein the pump chamber comprises a base outline having substantially straight boundary lines, and in that the diffuser element opens in an entry zone and the outlet passage is arranged opposed thereto.

8. The microejector pump according to claim 1, wherein the pump chamber comprises a base outline having curved boundary lines, and in that the diffuser element opens in an entry zone and the outlet passage is arranged opposed thereto.

9. The microejector pump according to claim 1, wherein the outlet passage is a microcapillary connectable between the pump chamber and the ejection orifice to additional supply passages.

10. The microejector pump according to claim 1, wherein the pump chamber is a composite of a micromechanically structured silicon chip and a glass chip.

11. The microejector pump according to claim 10, wherein the composite of silicon chip and glass chip is diminished in at least one of an x- and a y-direction towards the ejection orifice.

12. The microejector pump according to claim 1 further comprising a heater.

13. The microejector pump according to claim 12, wherein the heater is integrated into the silicon membrane of the silicon chip and electrical contacts are arranged laterally opposed to each other on the silicon chip.

14. The microejector pump according to claim 12 further comprising a temperature sensor arranged on the silicon chip; and a control circuit operatively coupled to the sensor and to the electrical contacts for providing control of the heater.

15. The microejector pump according to claim 14, wherein the electrical contacts and the temperature sensor consist of a photo-lithographically structured platinum or tantalum coating.

16. The microejector pump according to claim 1, further comprising a parallel arrangement of a plurality of pump chambers, each with a respective inlet diffuser and a respective outlet passage.

17. The microejector pump according to claim 16, further comprising at least one aspiration passage having an opening in the exit plane is interposed between adjacent outlet passages.

* * * * *